United States Patent [19]

Chang et al.

[11] Patent Number: 4,845,865

[45] Date of Patent: Jul. 11, 1989

[54] SHOE HAVING A VIBRATABLE ORNAMENT

[76] Inventors: Shyh T. Chang, No. 6, Lane 305, Sec. 3, Chung Shan Road, Tan Tzu Hsiang, Taichung Hsien; Koong M. Chang, No. 1782, Chung Cheng Rd., Tsao Tun Chen, Nan Tou Hsien, both of Taiwan

[21] Appl. No.: 171,803

[22] Filed: Mar. 22, 1988

[51] Int. Cl.[4] ..... A43B 23/24; A43B 3/30

[52] U.S. Cl. ..... 36/136; 36/112; 2/245

[58] Field of Search ..... 36/136, 112, 29, 3 R, 36/3 B, 1; 2/245

[56] References Cited

U.S. PATENT DOCUMENTS 1,542,189 6/1925 Thompson ..... 2/245
2,391,429 12/1945 Lipari ..... 2/245
3,738,024 6/1973 Matsuda ..... 36/136
4,009,528 3/1977 Villari, Jr. et al. ..... 36/29

*Primary Examiner*—James Kee Chi
*Attorney, Agent, or Firm*—Barnes & Thornburg

[57] ABSTRACT

A shoe including a mid-sole layer, a lower layer, an air compression cavity, an air envelope, a shoe pad, an inner and outer vamp and an ornament. The air envelope is connected to the air compression cavity via an air-transmission tube which extends from the air compression cavity, passes through the mid-sole layer, is layered between the front end and outer inner of the vamp and extends through to the upper side of the vamp. The air compression cavity is set between the mid-sole layer and the shoe pad corresponding to the position of the heel portion of the shoe so that the air compression cavity is compressed and decompressed periodly as the wearer is walking. The ornament is adhered to the air envelope and is vibrated up and down via the air forced in and out by the air compression cavity in walking.

2 Claims, 4 Drawing Sheets

SHOE HAVING A VIBRATABLE ORNAMENT

BACKGROUND OF THE INVENTION

This invention relates to a shoe construction which comprises a vibratable ornament driven by means of an air-transmission tube extending from a mid-sole layer and a front end of the shoe. One end of the air-transmission tube is connected to a hollow air compression cavity which is set near the heel of the sole and the other end thereof extends through the midsole layer and to the vamp from the front end. The air cavity will be compressed/decompressed periodly as the wearer walks so as to urge the air from the air transmission tube to drive the ornament set.

Conventional ornamental shoes are designed monotonously or with conformity in the sense that the ornament thereof is always fixed to the vamp of the shoe. Especially for children or fashion-conscious people, such designation can not attract their attention permanently, whether in daily life or on special occasions. Therefore, the shoes having vibratable ornament of this invention are made, especially for children and fashion-conscious teen-agers, for purposes of attracting the attention and interest of this age-group.

SUMMARY OF THE INVENTION

One object of this invention is to provide a shoe which comprises a air-transmission tube extending from an air cavity to a vamp of the shoe via a mid-sole layer to transmit the compressed air resulting from the user's walking to the ornament portion of the shoes.

Further objectives and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 1:
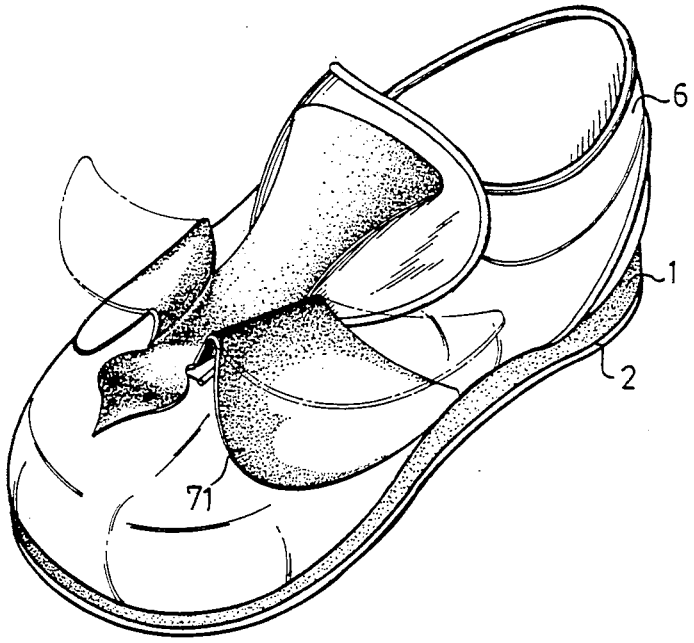
FIG. 1 is a perspective view of this invention.
Figure 2:
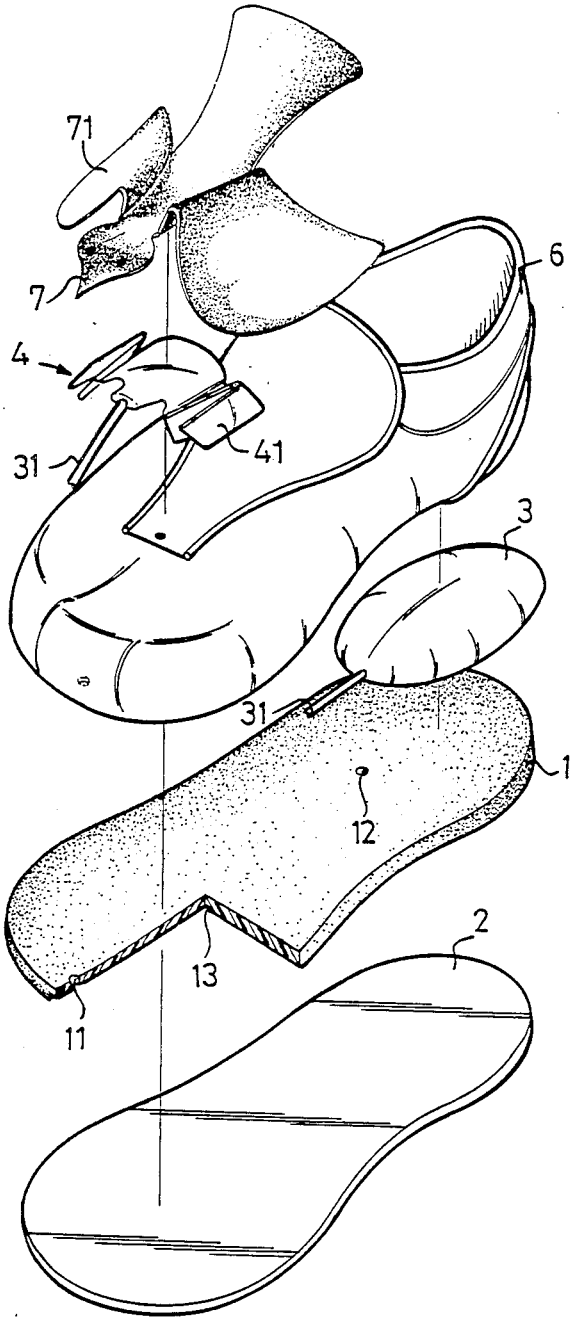
FIG. 2 is an exploded view of this invention.
Figure 3:
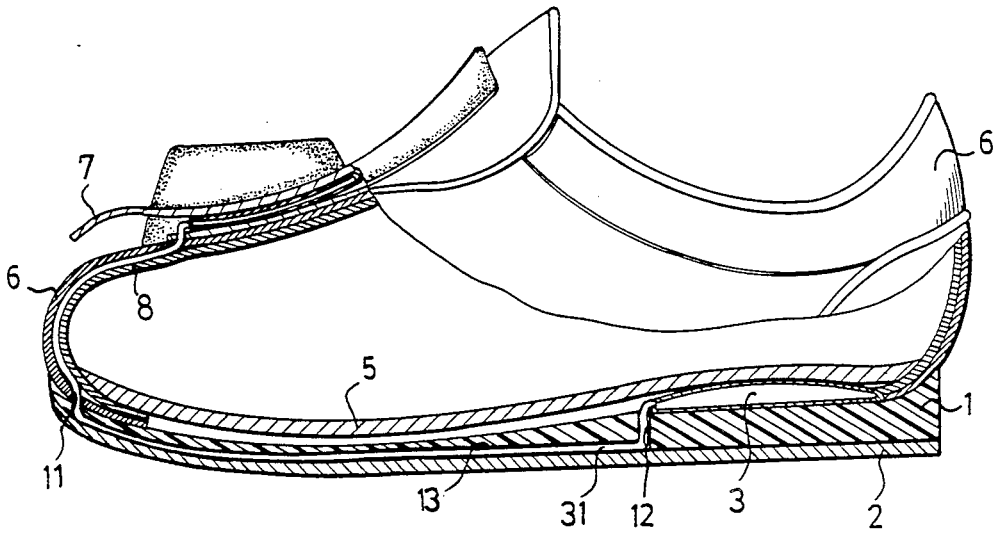
FIG. 3 is a sectional view of this invention.

As shown in FIG. 1 to FIG. 3, a shoe having a vibratable ornament in accordance with this invention comprises a mid-sole layer 1, lower layer 2, an air compression cavity 3, an air envelope 4, a shoe pad 5, an outer vamp 6 and an ornament 7. The air envelope 4, set near the front portion of the outer vamp 6, is connected with the air compression cavity 3 via an air-transmission tube 31 which extends from the air compression cavity 3 through the mid-sole layer 1, further through the front end of the vamp 6, between the layers thereof, to connect the air envelope 4.

Especially noting FIG. 3, the respective relationship of the constituent elements of this invention can be understood. The air compression cavity 1 is set at the heel portion of the shoe between the mid-sole layer 1 and the shoe pad 5. With reference to FIG. 2, it can be seen that the mid-sole layer 1 has two holes 11, 12 which are respectively set on the front and rear ends thereof at appropriate positions of the mid-sole layer 1 near the air compression cavity 3. A recess 13 is set on the bottom surface of the mid-sole layer 1 corresponding to and communicating with the two holes 11, 12 so that the two holes 11, 12 can be connected together via the recess 13.

The air-transmission tube 31 of the air compression cavity 3 passes through and engages with the recess 13 from hole 12 to hole 11 of the mid-sole layer. As FIG. 3 shows, the air-transmission tube 31 further passes through and is encompassed by the front end of the inner surface of the outer vamp 6 and an inner vamp 8. The air-transmission tube 31 extends out from the outer vamp 6 from an appropriate position and connected to the air envelope 4. The air envelope 4 comprises appropriate number of wings 41. As the air envelope 4 is connected to the air compression cavity 3, the wings 41 can be vibrated by means of the air-transmission tube 31 transmitting air resulting from the air compression cavity 3 being compressed.

Therefore, it is to be understood that the air compression cavity 3 is compressed periodly as the user walks and accordingly, compressed air is transmitted from the air-transmission tube 31 and compressing/decompressing the air envelope 4 when a wearer of the shoes of this invention walks on the shoes. Accordingly, the wings 41 of the air envelope 4 are driven to simultaneously vibrate up and down periodly in accordance with the walking of the user.

Figure 4:
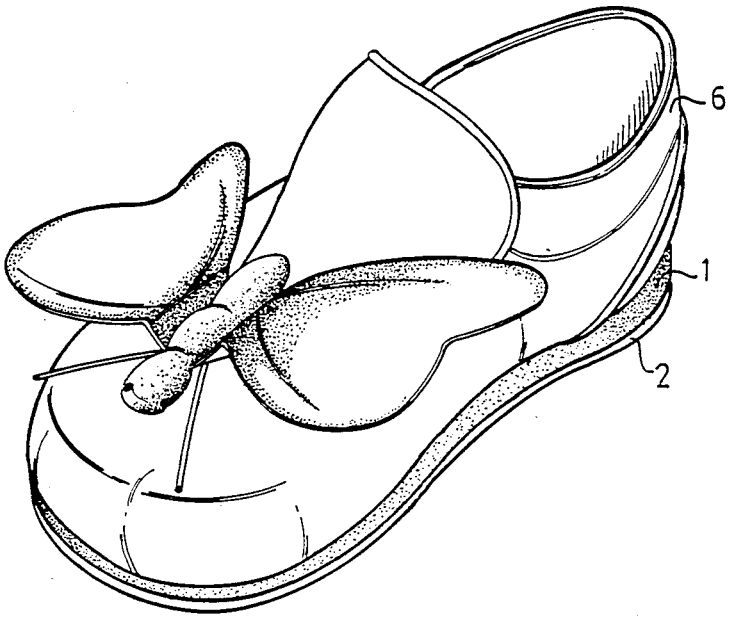
FIG. 4 is another embodiment of this invention.

To provide the ornament 7 with vibration effects, the ornament 7 forms special shapes (such as animals, birds, etc.) of soft material, and is adhered to the air envelope 4 so that the ornament 7 is vibrated up and down when a wearer is walking in conjunction with the compression or decompression of said air compression cavity 3. In FIG. 1, the ornament 7 is a bird model, i.e., the bird model looks like it is flying when the wearer is walking. Likewise, another embodiment of this invention is shown in FIG. 4 wherein the ornament 7 is a butterfly which appears to be flying while the user is walking.

The ornament 7 also can be designed based on other shapes for interesting purposes, such as a frog jumping, a bee hovering and so on, and the air envelope 4 can be designed in different manner, as necessary. It is noted that the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

I claim:

1. A shoe having a vibratable ornament comprising a mid-sole layer (1), a lower layer (2), an air compression cavity (3), an air envelope (4), a shoe pad (5), an outer vamp (6) and an ornament (7) wherein said air compression cavity (3) is connected with said air envelope (4) via an air-transmission tube (31); said air compression cavity (3) being set at a heel portion of said shoe between said shoe pad (5) and said mid-sole layer (1) and said air envelope (4) being set on an appropriate position of said outer vamp (6); said mid-sole layer (1) having two holes (11, 12) therethrough respectively set on a front and a rear end thereof and a recess (13) on a bottom surface thereof communicating said two holes (11, 12) for the engagement of said air-transmission tube (31); said air-transmission tube (31) passing through the recess (13) of said mid-sole layer (1) from said hole (12) to hole (11) near the front of said mid-sole layer (1) encompassing the front end of the inner suface of said outer vamp (6) and finally extending from said outer vamp (6) to connect to said air envelope (4); said air compression cavity (3) being periodically compressed so as to force air therein to be transmitted to said air envelope (4) via said air-transmission tube (31) when a wearer walks on said shoe; said air envelope (4) comprising appropriate number of wings on which said ornament (7) is adhered so that said ornament (7) is vibrated up or down periodly in conjunction with the compression or decompression of said air compression cavity (3).

2. A shoe according to claim 1, wherein the air transmission tube passes within the front end of the outer vamp (6) after it passes through the hole (11) near the front of said mid-sole layer (1).

* * * * *